US011727899B2

(12) United States Patent
Richter

(10) Patent No.: US 11,727,899 B2
(45) Date of Patent: Aug. 15, 2023

(54) CHIN REST

(71) Applicant: Meade Grey Richter, Sugar Grove, NC (US)

(72) Inventor: Meade Grey Richter, Sugar Grove, NC (US)

( * ) Notice: Subject to any disclaimer, the term of this patent is extended or adjusted under 35 U.S.C. 154(b) by 3 days.

(21) Appl. No.: 17/529,084

(22) Filed: Nov. 17, 2021

(65) Prior Publication Data

US 2022/0157278 A1 May 19, 2022

Related U.S. Application Data

(60) Provisional application No. 63/114,829, filed on Nov. 17, 2020.

(51) Int. Cl.
*G10D 3/18* (2020.01)

(52) U.S. Cl.
CPC ..... *G10D 3/18* (2013.01)

(58) Field of Classification Search
CPC ..... G10D 3/18; G10D 3/00
See application file for complete search history.

(56) References Cited

U.S. PATENT DOCUMENTS 3,827,329 A * 8/1974 Annessa ..... G10D 3/18 984/124

* cited by examiner

*Primary Examiner* — Kimberly R Lockett
(74) *Attorney, Agent, or Firm* — The Van Winkle Law Firm; William G. Heedy; Sam Ferrell Alman, Jr.

(57) ABSTRACT

A chin rest includes a top panel, side panel, and tailpiece strap with snap components, and together provide a surface on which a musician may place their chin while playing an instrument. The side panel includes an endpin hole designed to fit snugly over and around the endpin of an instrument to hold the chin rest to the surface of the instrument. A tailpiece strap extends from the top panel to form a loop around the tailpiece of an instrument, securing the chin rest to the instrument. A male snap connector is embedded in the end of the tailpiece strap and a female snap connector is embedded in the top panel, adjacent to the tailpiece strap. A raised, exterior border surrounds the exterior edge of the top and/or side panels, creating a negative space to provide a cradle for a musician's chin.

18 Claims, 18 Drawing Sheets

CHIN REST

RELATED APPLICATION

This application claims priority to and incorporates entirely by reference U.S. Provisional Patent Application Ser. No. 63/114,829 filed on Nov. 17, 2020.

FIELD OF THE INVENTION

This invention relates to a chin rest for a violin, viola, or similar stringed instrument, and, more particularly, to a chin rest that provides an improved attachment mechanism, improved protection to the instrument, and improved protection of the musician.

BACKGROUND OF THE INVENTION

Chin rests are widely used by musicians playing the violin, viola, and similar stringed instruments. Chin rests provide a protective surface on which to position a player's jaw or chin on the instrument, allowing the player to grip the instrument between the jaw and the shoulder or collarbone area. The chin rest also functions to protect the instrument itself from the pressure exerted by a musician's chin or jaw as well as from damage to the violin surface by surface oil and dirt transferred from a musician's skin.

Generally, a chin rest is attached to the instrument using tensioning brackets that clamp the chin rest to the top of the violin body and an opposing tensioning member or feet to the bottom of the violin. These tensioning members may be composed of metal or similarly rigid materials.

Tensioning brackets can loosen over time and require a special tool to be adjusted and tightened. Overtightening of the tensioning brackets can cause damage to the violin body and components. Under-tightening of the tensioning brackets can cause the chin rest assembly to be too loosely attached, thereby potentially resulting in vibration between the chin rest and the instrument. Such vibrations can lead to an unpleasant buzzing sound when a musician is playing the instrument. Similarly, if the chin rest is not positioned correctly on the violin body, it can cause vibrations which lead to an unpleasant buzzing sound.

Furthermore, when a tensioning bracket is attached to a wooden instrument, changes in the surrounding humidity and/or air temperature can cause the wood to crack or deform as the wood of the instrument expands and contracts against the rigid metal of the tensioning bracket.

Generally, chin rests are constructed from hard plastic or wood, and these materials can prove uncomfortable to musicians during long periods of use. This discomfort may be particularly acute where the shape of the chin rest is not fitted to the user's chin or jaw. Moreover, due to the nature of materials such as wood or plastic, such chin rests will not conform to the user's anatomy over time.

In attempts to alleviate this problem, some musicians install a soft cover over the chin rest. These covers, however, do not provide the necessary structure for effectively holding the instrument between the chin and shoulder area and may not provide a comfortable surface for the musician. A cover also requires an additional attachment mechanism that may crowd and complicate the body of the instrument, as well as affect the sound quality of the violin. These covers may be attached by, for example, elastic straps that apply tension to the body of the instrument, potentially altering or damaging the shape of the instrument.

Accordingly, there exists a need for a chin rest to be attached to a violin, viola, or similar instrument to provide improved protection of the instrument as well as improved protection and comfort for the musician.

SUMMARY OF THE INVENTION

In accordance with one form of this invention, there is provided a violin chin rest. In one embodiment, the violin chin rest is designed to fit a standard violin or viola and may be easily sized proportionally to fit different size instruments.

The chin rest includes a top panel and side panel connected via a seam. The side panel includes an endpin hole that is sized to fit over and tightly surround the endpin of an instrument. A tailpiece strap is connected to the top panel to secure the chin rest to the tailpiece of the instrument. In one embodiment, a snap assembly is embedded in the tailpiece strap and top panel to secure the tailpiece strap around the tailpiece of the instrument.

An exterior border surrounds the external edges of the top panel and the side panel of the chin rest.

BRIEF DESCRIPTION OF THE DRAWINGS

For a fuller understanding of the nature of the present invention, reference should be made to the following detailed description, taken in conjunction with the accompanying drawings in which.

Like reference numerals refer to like reference parts throughout the several views of the drawings.

DETAILED DESCRIPTION

Referring to the several views of the drawings, the chin rest is shown and described herein, and is generally indicated as 10.

Figure 1:
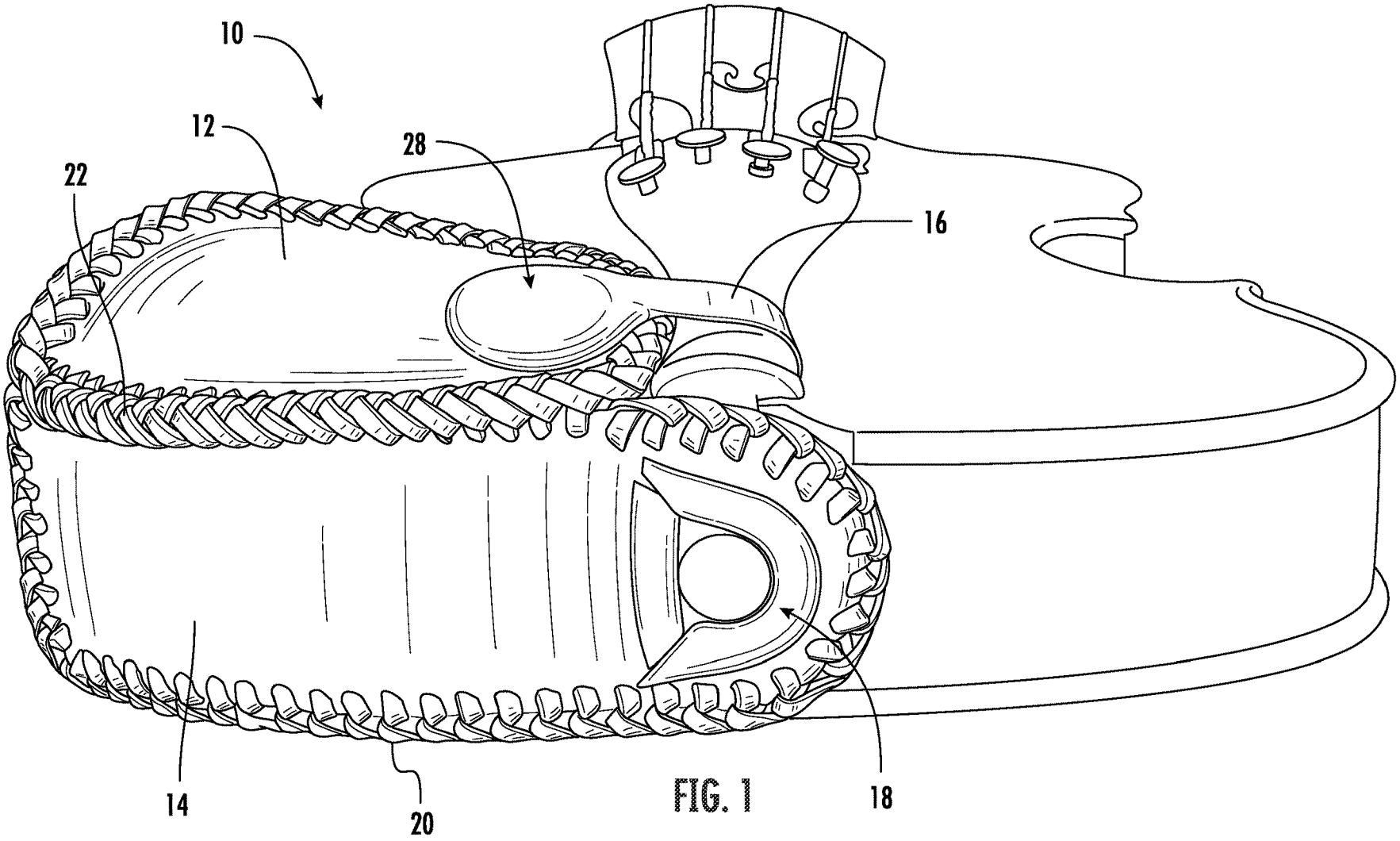
FIG. 1 is a rear profile view of the chin rest attached to a violin, according to one embodiment.

Referring initially to FIG. 1, the chin rest 10 is designed to be selectively installed and removed from a violin, viola, or similar stringed instrument. The chin rest 10 is attached to the body of the violin by the endpin hole 18 and the tailpiece strap 16. The chin rest 10 is primarily formed of a top panel 12, side panel 14, and tailpiece strap 16.

The top panel 12 rests on top of the violin body and the side panel 14 rests on the side of the violin body. The top panel 12 and side panel 14 may be formed and contoured to create a shape wherein a negative space is formed to allow the chin rest 10 to fit snugly against the body of the instrument.

It will be appreciated that the chin rest 10 and its components may be proportionally sized and shaped to fit different sizes of violins, violas, and other similar stringed instruments without departing from the spirit of the invention.

The tailpiece strap 16 is attached to or is an extension of the top panel 12. The tailpiece strap 16 may be a separate piece of material that is attached to the top panel 12 or it may be an extension of the same material as the top panel 12. The tailpiece strap 16 is designed to pass under and around the tailpiece of the violin, wherein it is secured to the top panel 12 via a snap connection 28 that is embedded in the top panel 12. The snap connection 28 may be a magnetic snap connection, a rivet snap connection, hook-and-loop connection, or similar means of connection.

The tailpiece strap 16 is dimensioned sufficient to allow the male snap component 24 to pass underneath and over the tailpiece of the violin and be joined with a receiving component 25, such as a female snap component 26. The tailpiece strap 16 dimensions should allow the tailpiece strap 16 to secure the chin rest 10 against the body of the violin but should be sufficiently loose so as not to place excessive pressure on the tailpiece of the violin. It will be appreciated that these dimensions may be adjusted proportionately to accommodate different sizes of violins, viola, or similar stringed instrument.

The endpin hole 18 is designed to fit over and around the endpin of an instrument. The endpin hole 18 fits snugly around the endpin to hold the chin rest 10 to the surface of the violin while in use. The endpin hole 18 is sized to fit loosely enough to be removed without extraneous effort from a user.

In one embodiment, the tailpiece strap 16 and endpin hole 18 function together to secure the chin rest 10 to the body of an instrument.

Connection stitching 22 comprises a seam connecting top panel 12 to side panel 14. In one embodiment, connection stitching 22 comprises a double cordovan stitch pattern or similar stitching pattern. It will be appreciated that other connection methods may be used to attach top panel 12 to side panel 14, or the top panel 12 and side panel 14 may be composed of a single continuous material.

Exterior border 20 is located along the edge of the side panel 14 and the edge of the top panel 12, terminating at the connection stitching 22. The exterior border 20 comprises a double cordovan stitch pattern or similar stitching pattern. It will be appreciated that other stitching methods may be used to create the exterior border 20.

In addition to providing a decorative and protective edge along chin rest 10, in one embodiment, the exterior border 20 provides a raised surface along the edges of the top panel 12. This raised surface creates a negative contour to fit a user's chin and jawline and provides a convenient space on which a user may position their chin/jawline when gripping the instrument between the chin/jawline and the shoulder area.

By providing this negative contour on which a user may rest their chin/jawline, pressure on the instrument is displaced outwardly away from the chin/jawline point of contact, thus protecting the body of the instrument.

Figure 2:
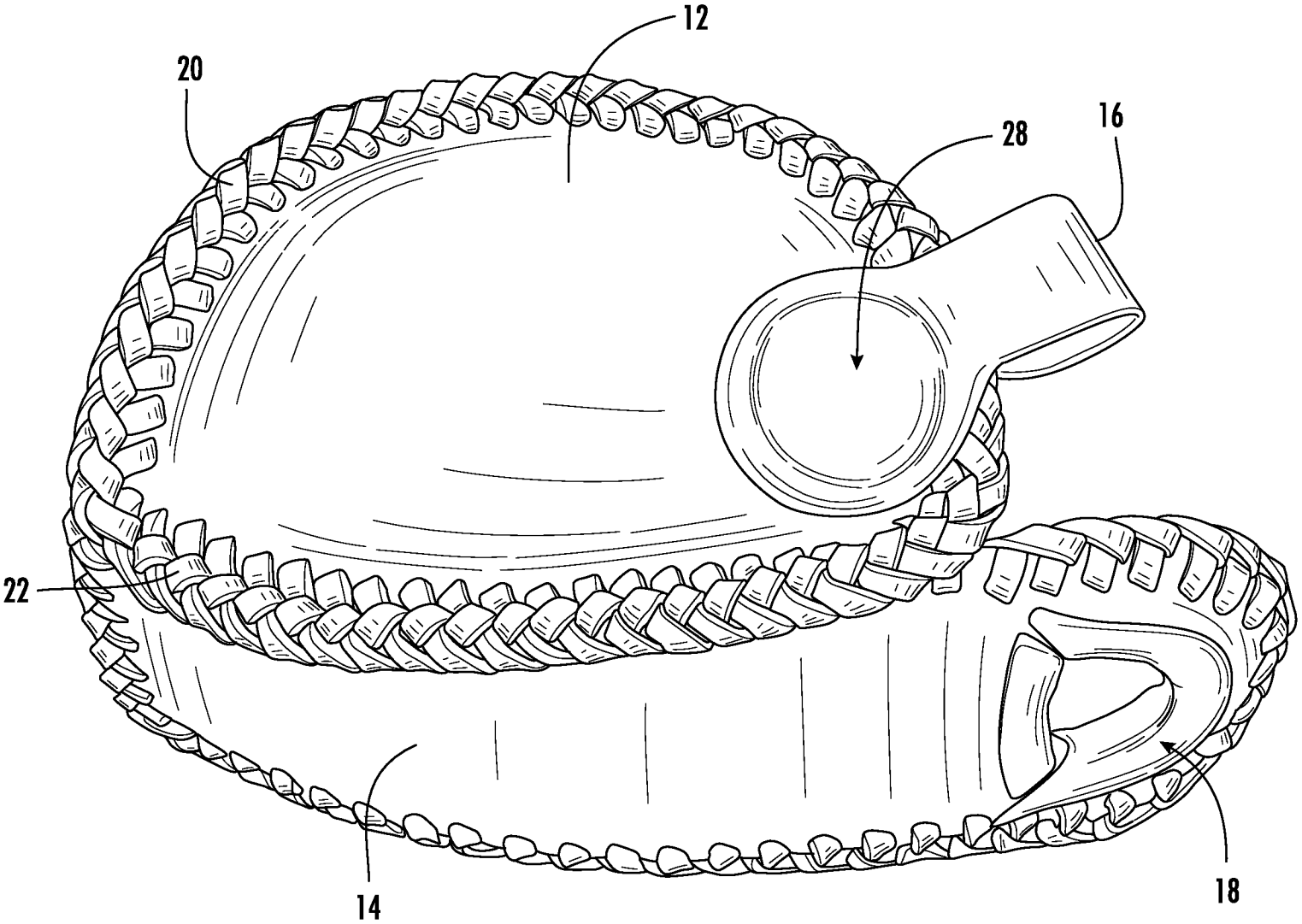
FIG. 2 is a top view of the chin rest, according to one embodiment.
Figure 7:
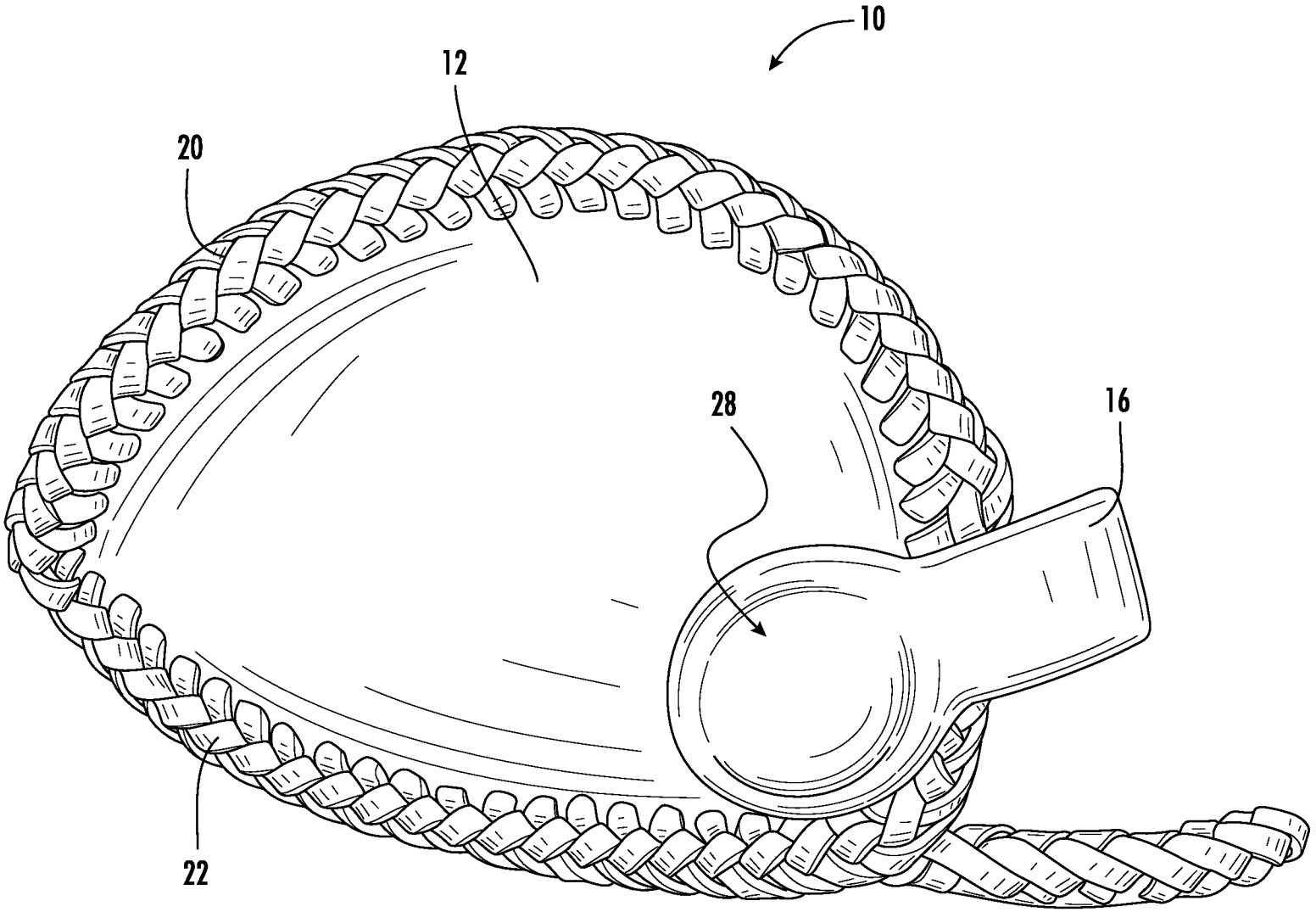
FIG. 7 is a top view of the chin rest, according to one embodiment, showing the tailpiece strap attached via a snap connection.

Referring now to FIGS. 2 and 7, the chin rest 10 can be seen from a top view in which the tailpiece strap 16 is attached to the top panel 12 via the snap component 28. In one embodiment the top panel 12 may be composed of a pliable material such as leather, foam, or similar material that may hold an impression upon applied pressure.

Figure 3:
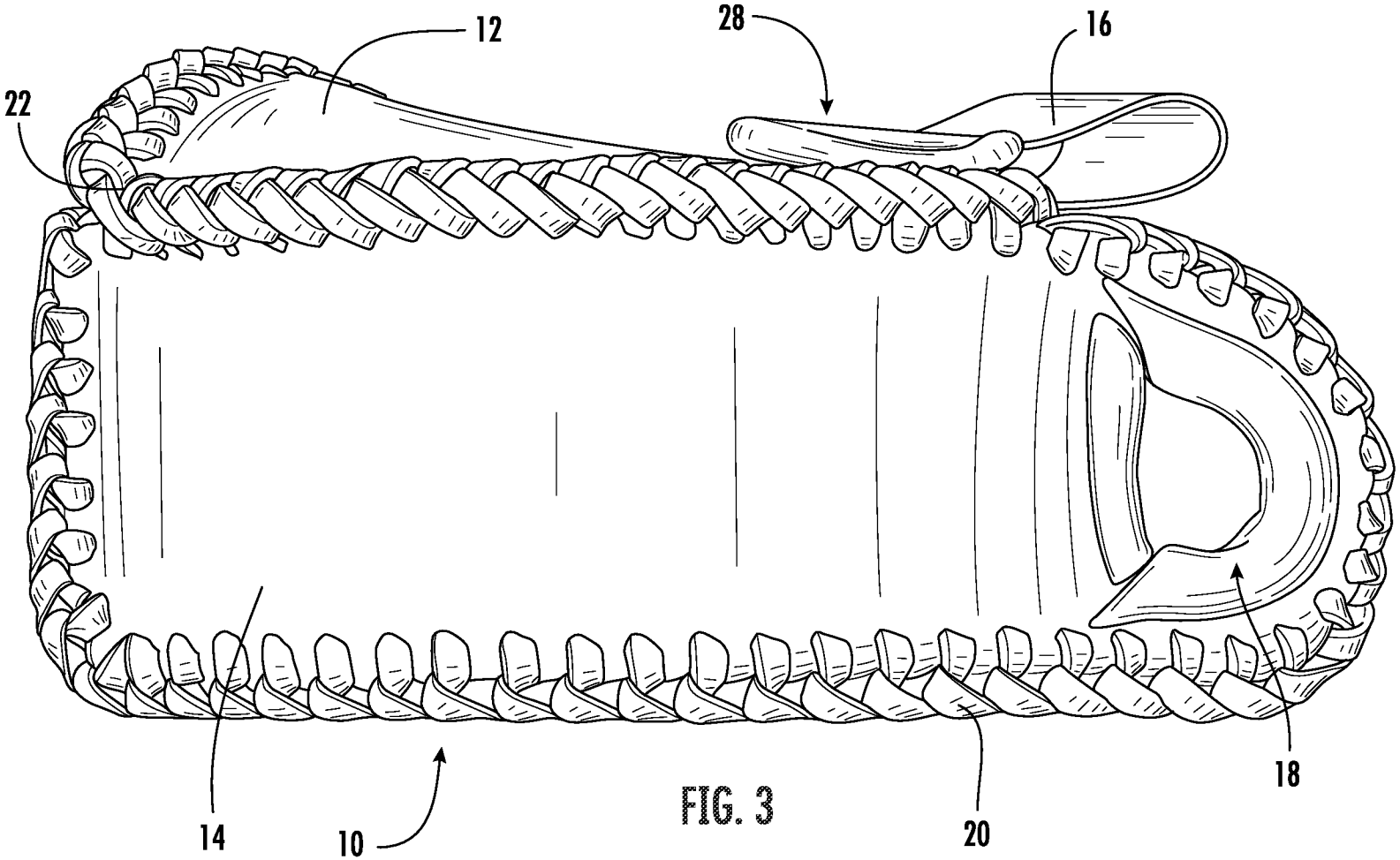
FIG. 3 is a rear elevational view of the chin rest, according to one embodiment.

FIG. 3 shows a rear view of the chin rest 10, showing the endpin hole 18, and the tailpiece strap 16 is attached.

Figure 4:
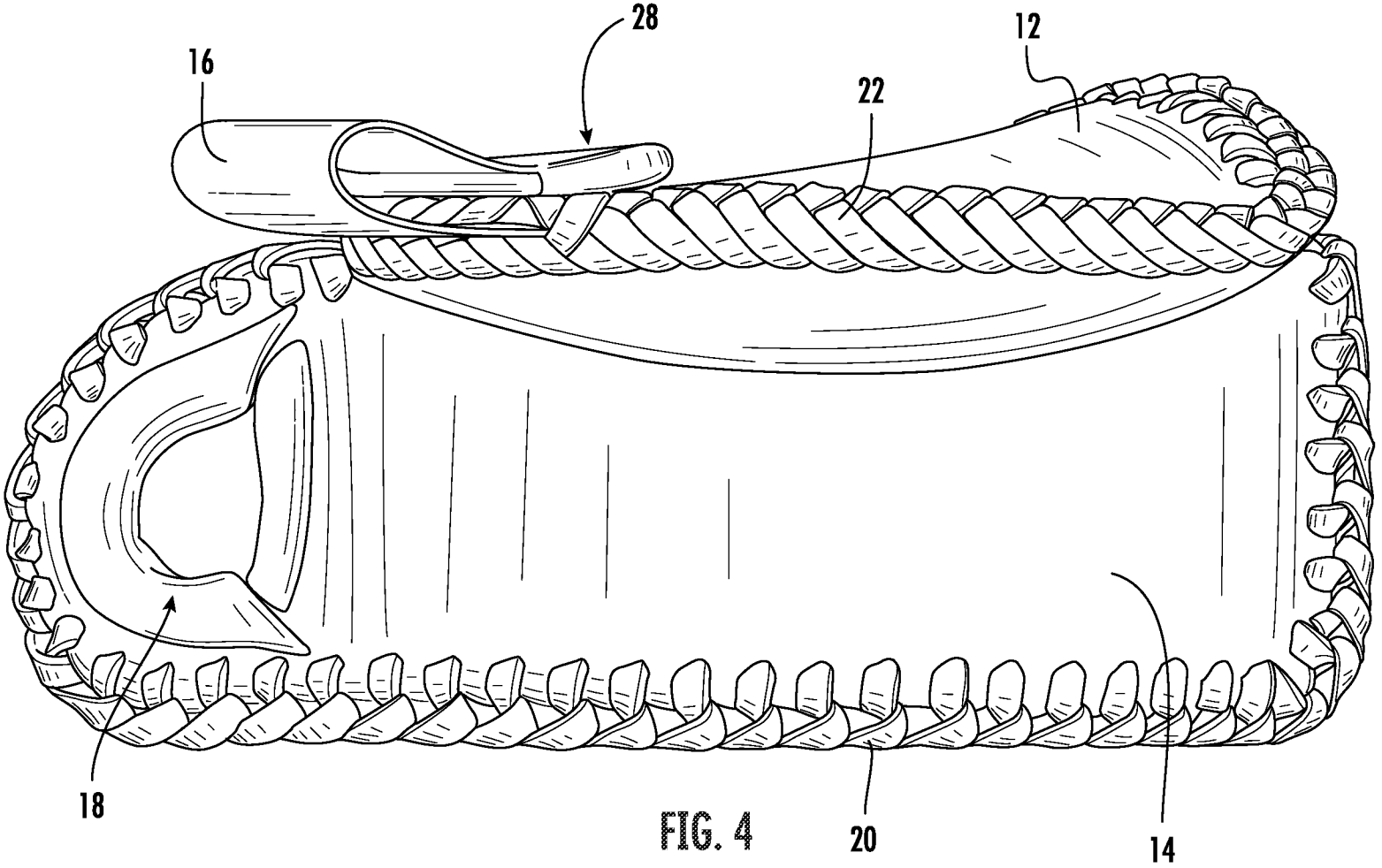
FIG. 4 is a front elevational view of the chin rest, according to one embodiment.

FIG. 4 is a front elevational view of the chin rest 10.

Figure 5:
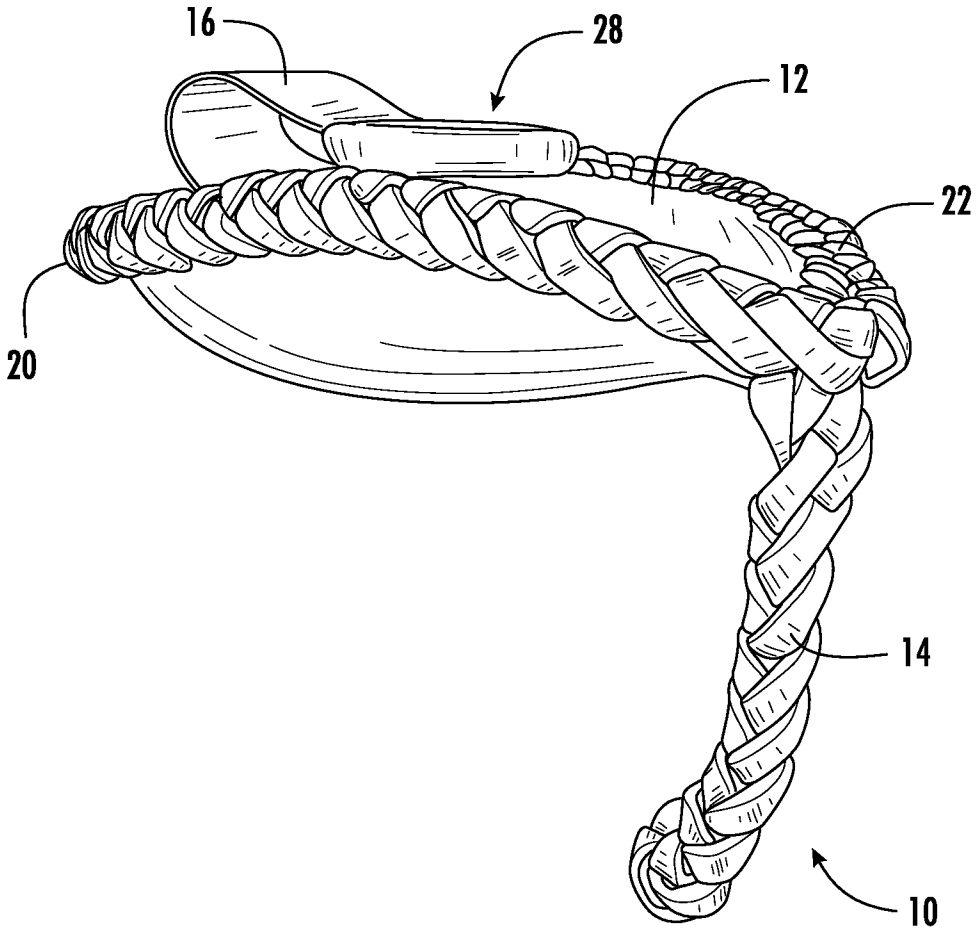
FIG. 5 is a side elevational view of the chin rest, according to one embodiment.

FIG. 5 is a side view of the chin rest 10.

Figure 6:
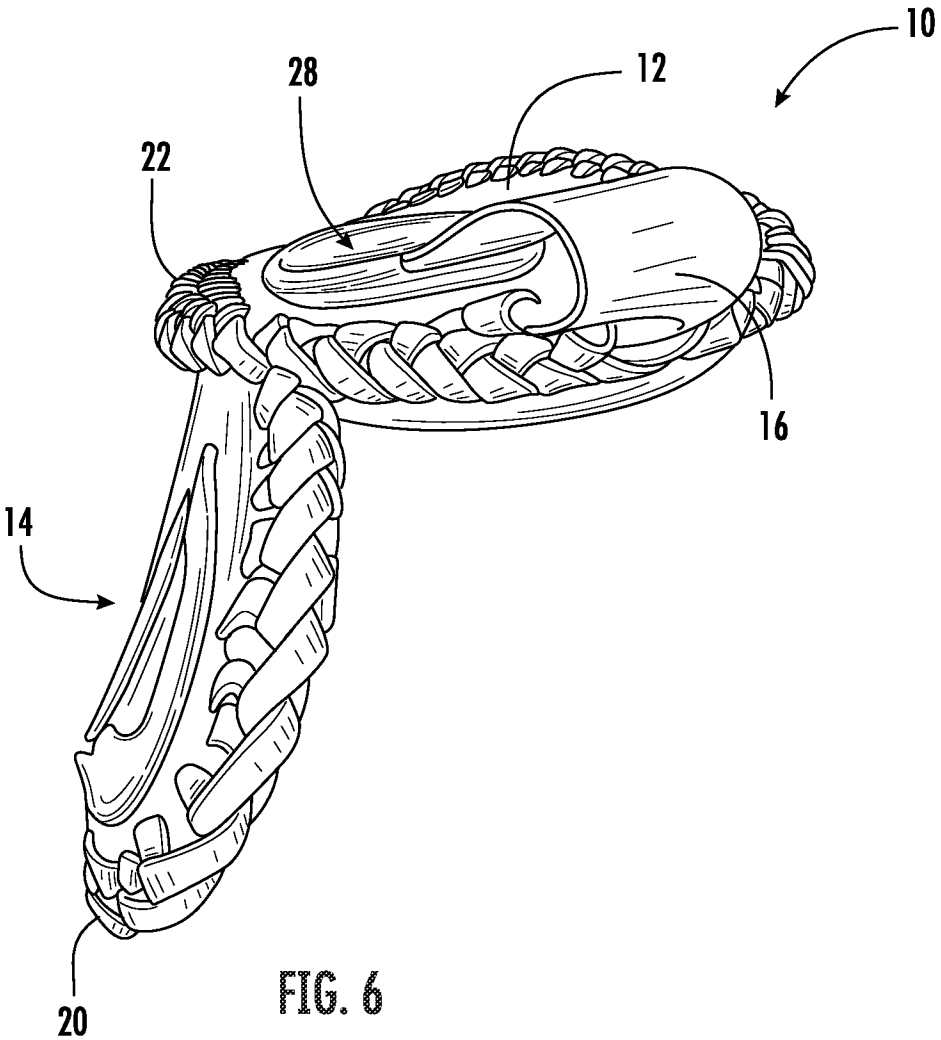
FIG. 6 is a side elevational view of the chin rest, according to one embodiment.

FIG. 6 is a side view of the chin rest 10.

Figure 8:
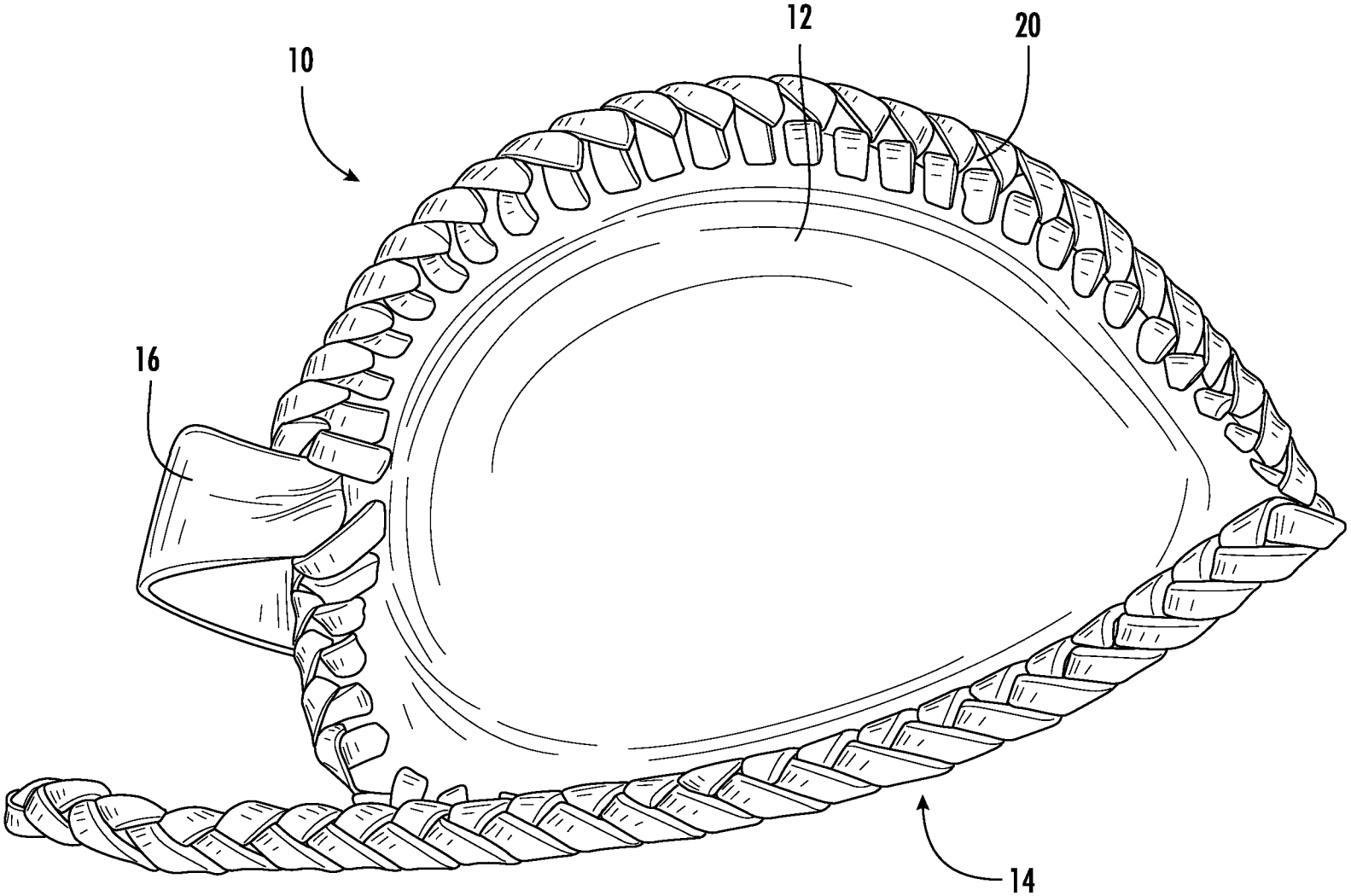
FIG. 8 is a bottom view of the chin rest, according to one embodiment.

FIG. 8 is a bottom view of the chin rest 10, showing the underside of the top panel 12, side panel 14, and tailpiece strap 16. The top panel 12 and side panel 14 may be formed and contoured to create a shape wherein a negative space is formed to allow the chin rest 10 to fit snugly against the body of the instrument.

Figure 9:
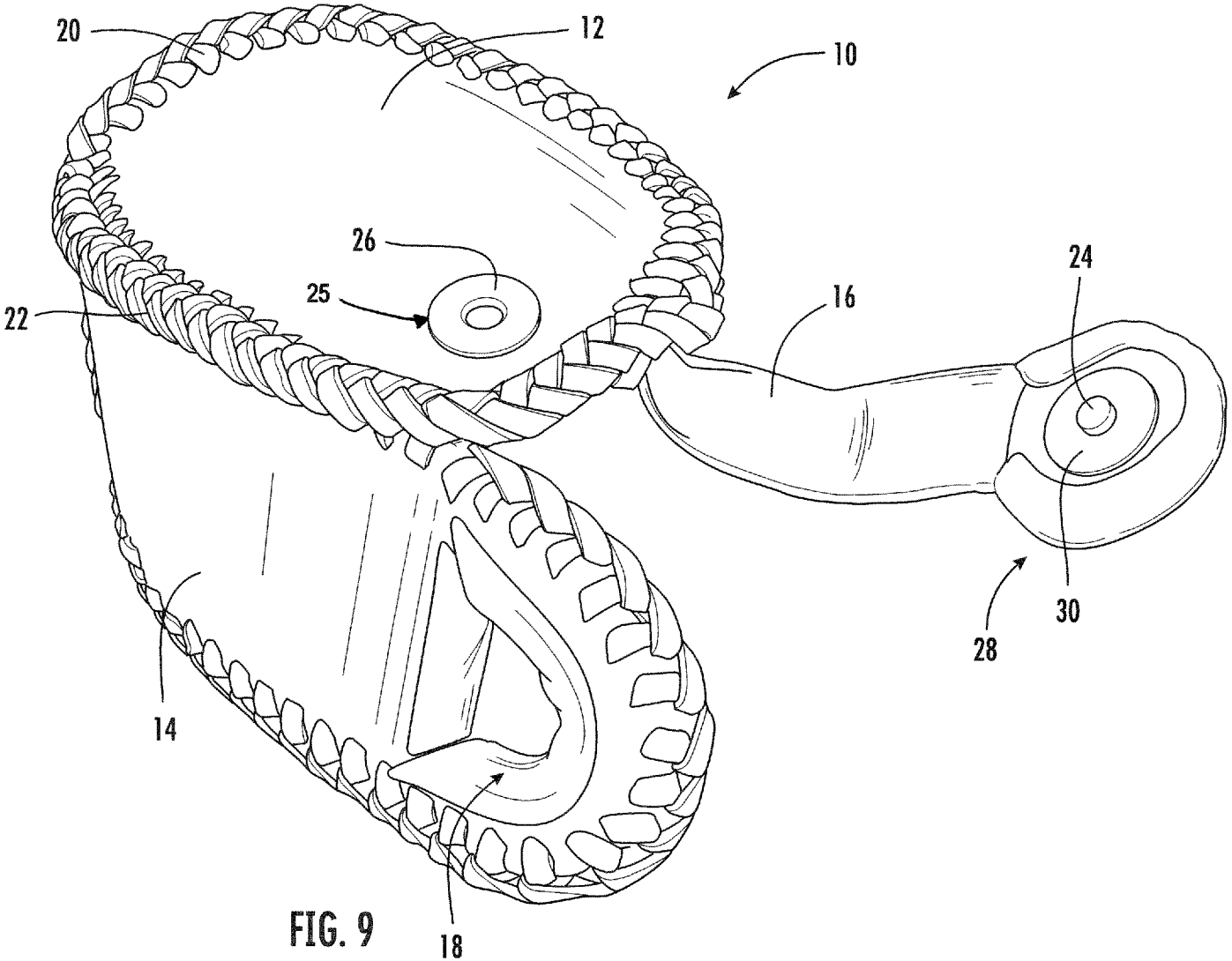
FIG. 9 is a side profile view of the chin rest, according to one embodiment.

Referring now to FIG. 9, the tailpiece strap 16 can be seen unattached from the top panel 12. In one embodiment shown, the male snap component 24 is embedded in the end of the tailpiece strap 16. The female snap component 26 is embedded in the top panel 12 of the chin rest and may be located adjacent to the attachment point of the tailpiece strap 16. The male snap component 24 of tailpiece strap 16 is designed to pass under and around the tailpiece of a violin, wherein it is secured to the top panel 12 via the female snap component that is embedded in the top panel 12. The snap connection 28 may be a magnetic snap connection, a rivet snap connection, hook-and-loop connection, or similar means of connection.

In one embodiment, the male snap component 24 is surrounded by snap component border 30, which is a raised border surrounding the male snap component 24. The raised nature of the snap component border 30 creates an insulative border around the male snap component 24 and the protruding female snap component 26, to contain and hide the snap connection 28 hardware (male snap component 24 and female snap component 26.)

Figure 10:
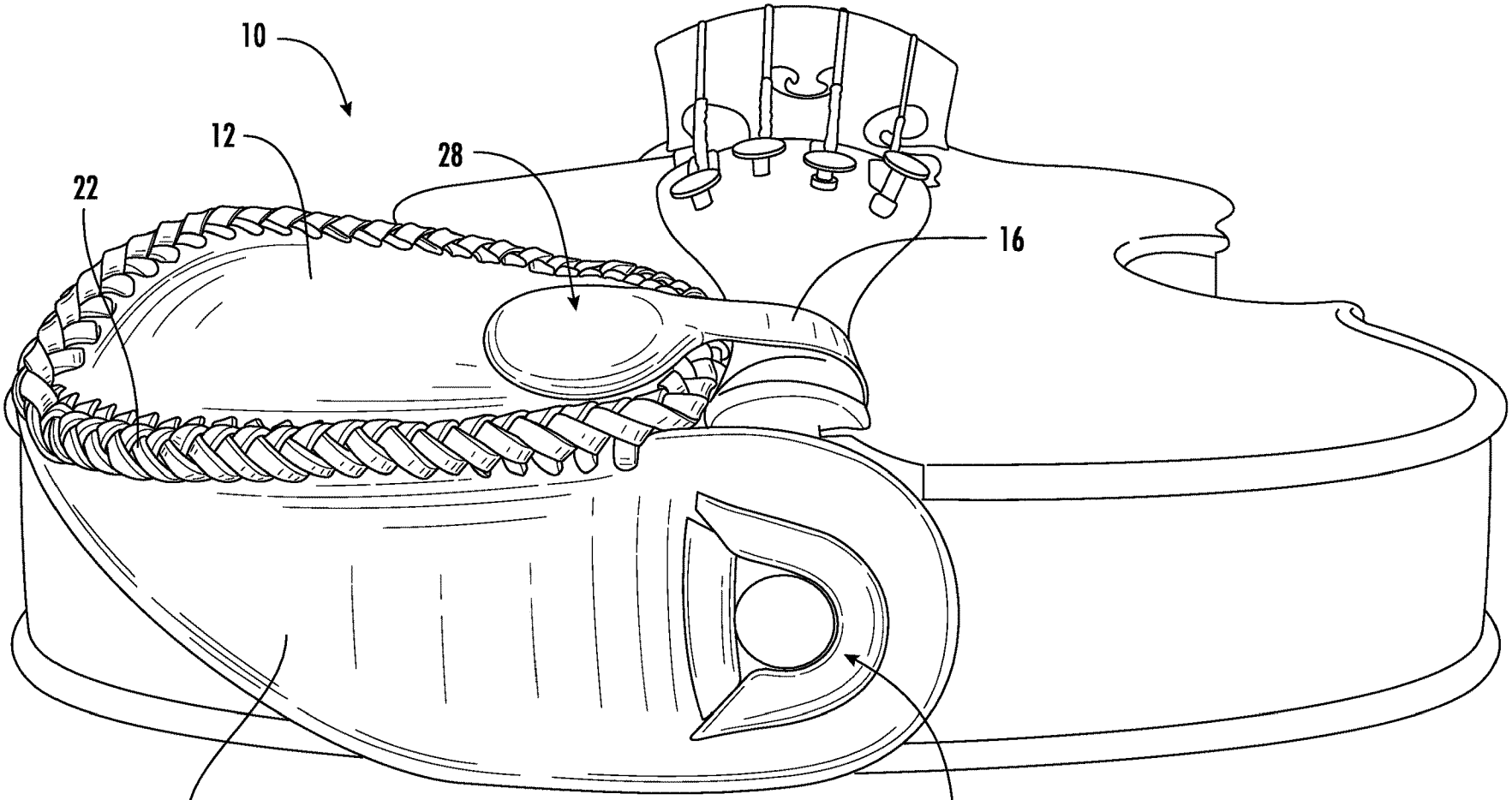
FIG. 10 is a rear view of the chin rest attached to a violin, according to one embodiment.

FIG. 10 is a rear view of the chin rest 10 attached to the violin. The tailpiece strap 16 is attached to the tailpiece of the violin and secured by the snap connection 28.

Referring now to FIGS. 11-18, another embodiment of the chin rest 10 is shown. The chin rest 10 is designed to be selectively installed and removed from a violin, viola, or similar stringed instrument. The chin rest 10 is attached to the body of the violin by the endpin hole 18 and the tailpiece strap 16. The chin rest 10 is primarily formed of a top panel 12, side panel 14, and tailpiece strap 16.

The top panel 12 rests on top of the violin body and the side panel 14 rests on the side of the violin body. The top panel 12 and side panel 14 may be formed and contoured to create a shape wherein a negative space is formed to allow the chin rest 10 to fit snugly against the body of the instrument.

It will be appreciated that the chin rest 10 and its components may be proportionally sized and shaped to fit different sizes of violins, violas, and other similar stringed instruments without departing from the spirit of the invention.

The tailpiece strap 16 is attached to or is an extension of the top panel 12. The tailpiece strap 16 may be a separate piece of material that is attached to the top panel 12 or it may be an extension of the same material as the top panel 12. The tailpiece strap 16 is designed to pass under and around the tailpiece of the violin, wherein it is secured to the top panel 12 via a snap connection 28 that is embedded in the top panel 12. The snap connection 28 may be a magnetic snap connection, a rivet snap connection, hook-and-loop connection, or similar means of connection.

The tailpiece strap 16 is dimensioned sufficient to allow the male snap component 24 to pass underneath and over the tailpiece of the violin and be joined with the female snap component 26. The tailpiece strap 16 dimensions should allow the tailpiece strap 16 to secure the chin rest 10 against the body of the violin but should be sufficiently loose so as not to place excessive pressure on the tailpiece of the violin. It will be appreciated that these dimensions may be adjusted proportionately to accommodate different sizes of violins, viola, or similar stringed instrument.

The endpin hole 18 is designed to fit over and around the endpin of an instrument. The endpin hole 18 fits snugly around the endpin to hold the chin rest 10 to the surface of the violin while in use. The endpin hole 18 is sized to fit loosely enough to be removed without extraneous effort from a user.

In one embodiment, the tailpiece strap 16 and endpin hole 18 function together to secure the chin rest 10 to the body of an instrument.

Connection stitching 22 comprises a seam connecting top panel 12 to side panel 14. In one embodiment, connection stitching 22 comprises a double cordovan stitch pattern or similar stitching pattern. It will be appreciated that other connection methods may be used to attach top panel 12 to side panel 14, or the top panel 12 and side panel 14 may be composed of a single continuous material.

Figure 11:
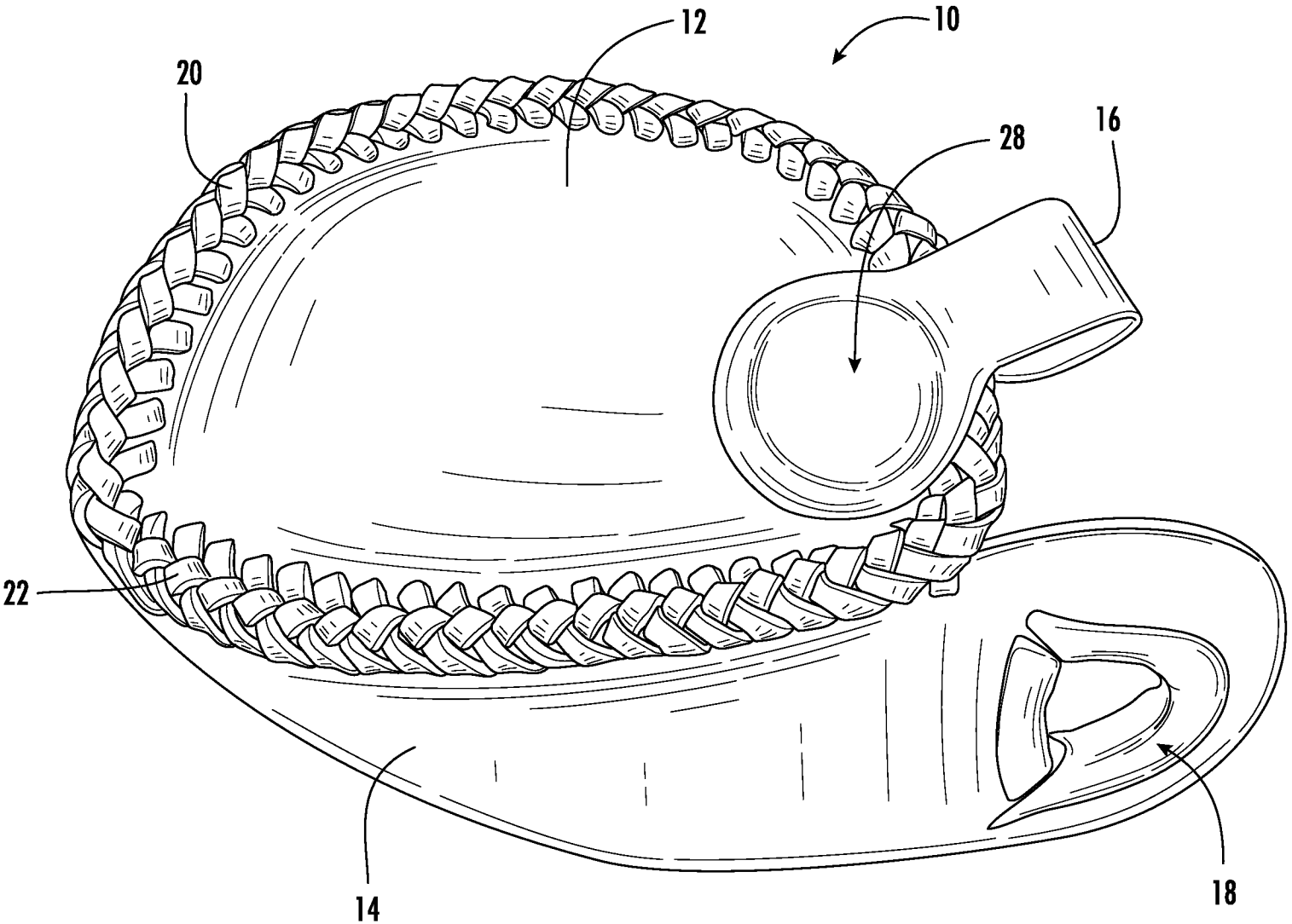
FIG. 11 is top elevational view of the chin rest, showing the tailpiece strap attached, according to one embodiment.
Figure 12:
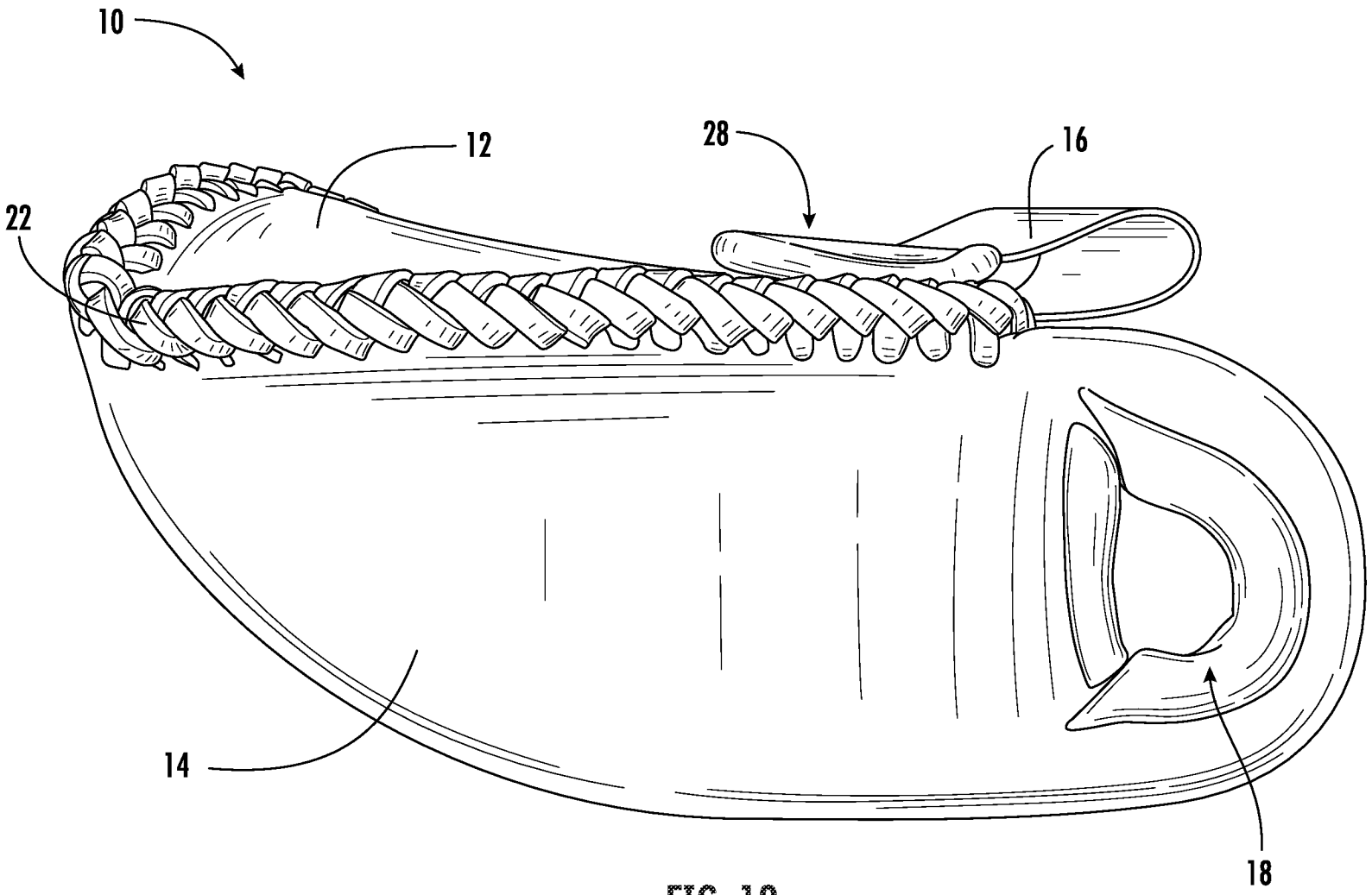
FIG. 12 is a rear view of the chin rest, according to one embodiment.
Figure 13:
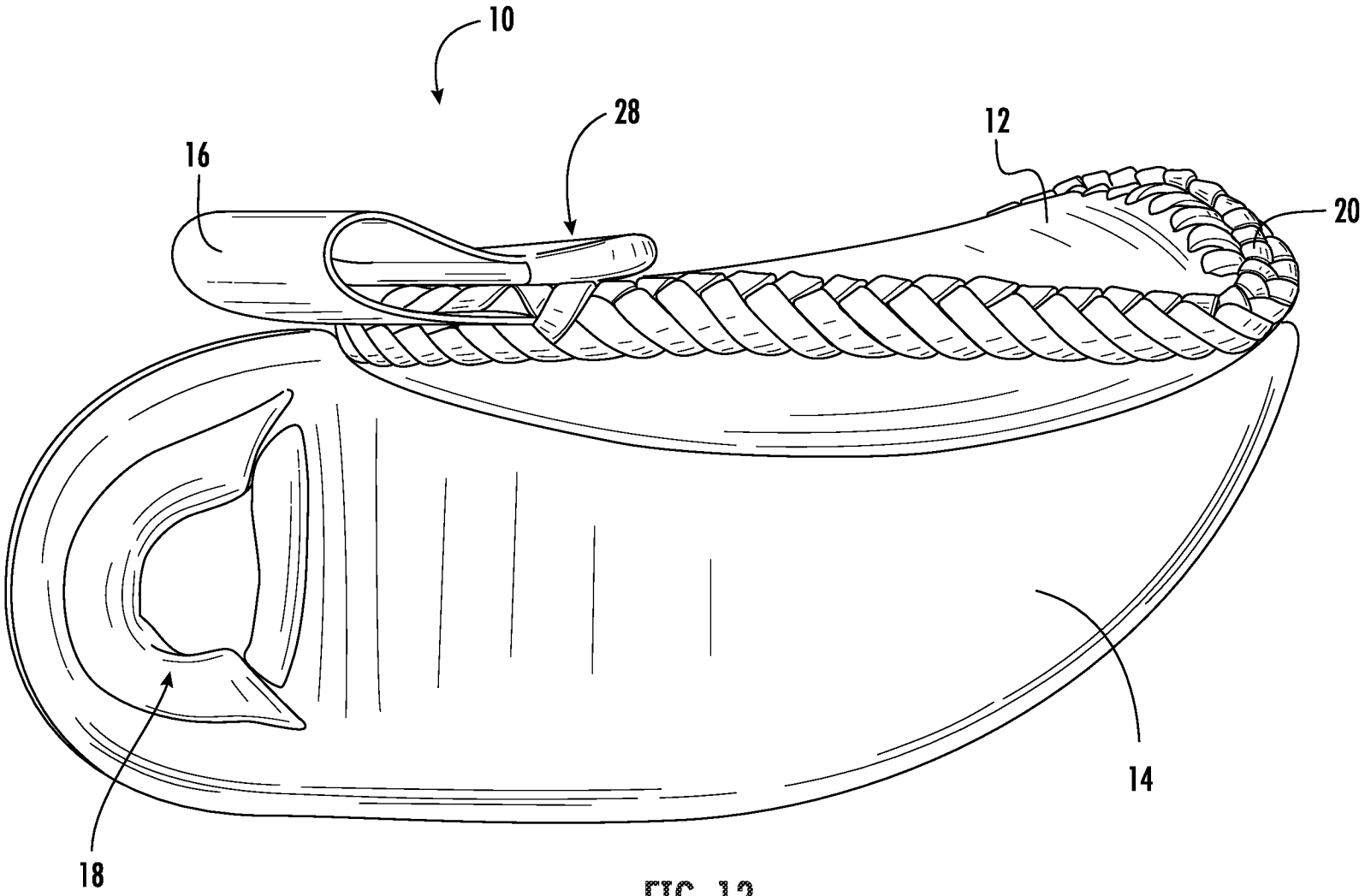
FIG. 13 is a front view of the chin rest, according to one embodiment.
Figure 14:
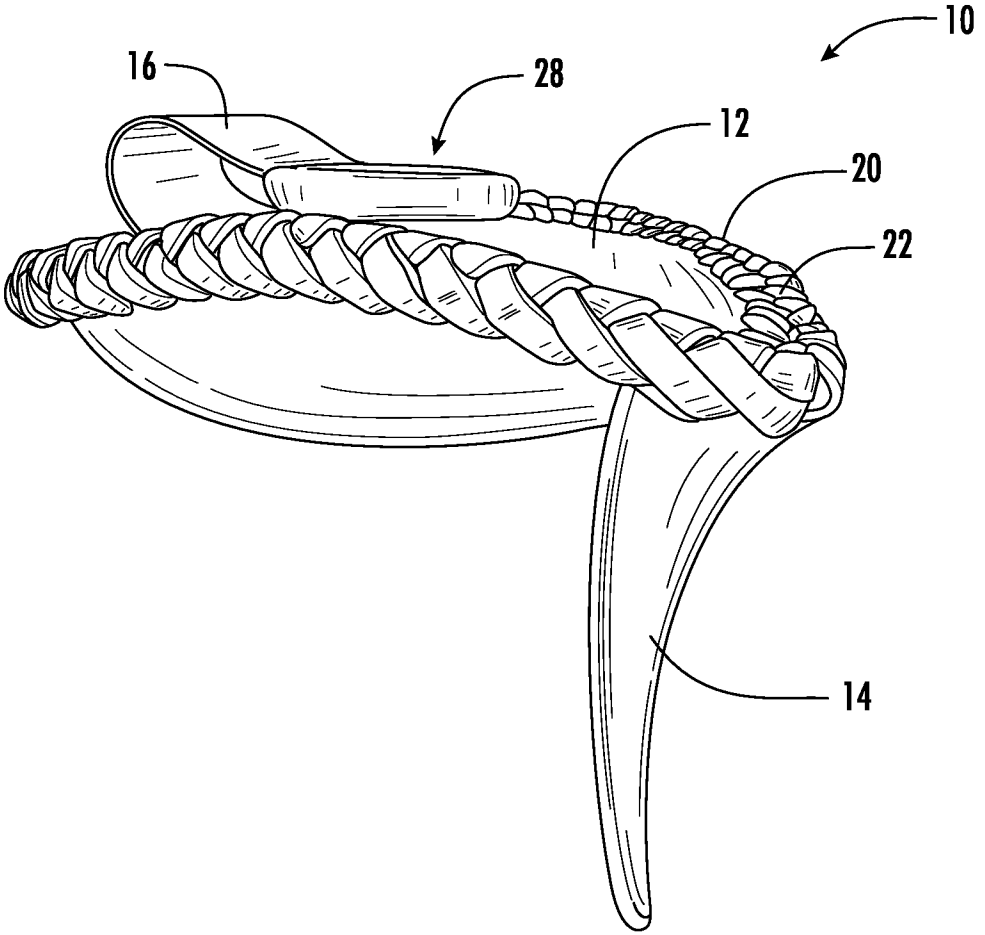
FIG. 14 is a side elevational view of the chin rest, according to one embodiment.
Figure 15:
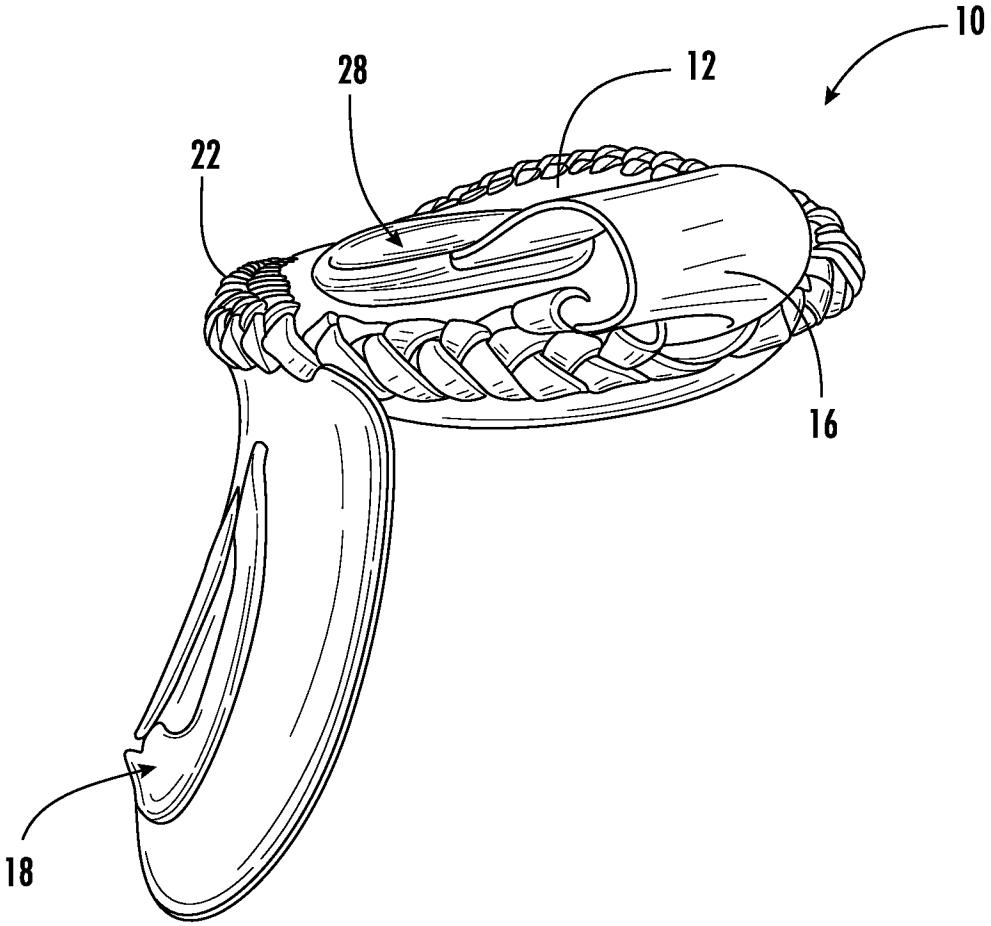
FIG. 15 is a side elevational view of the chin rest, according to one embodiment.
Figure 16:
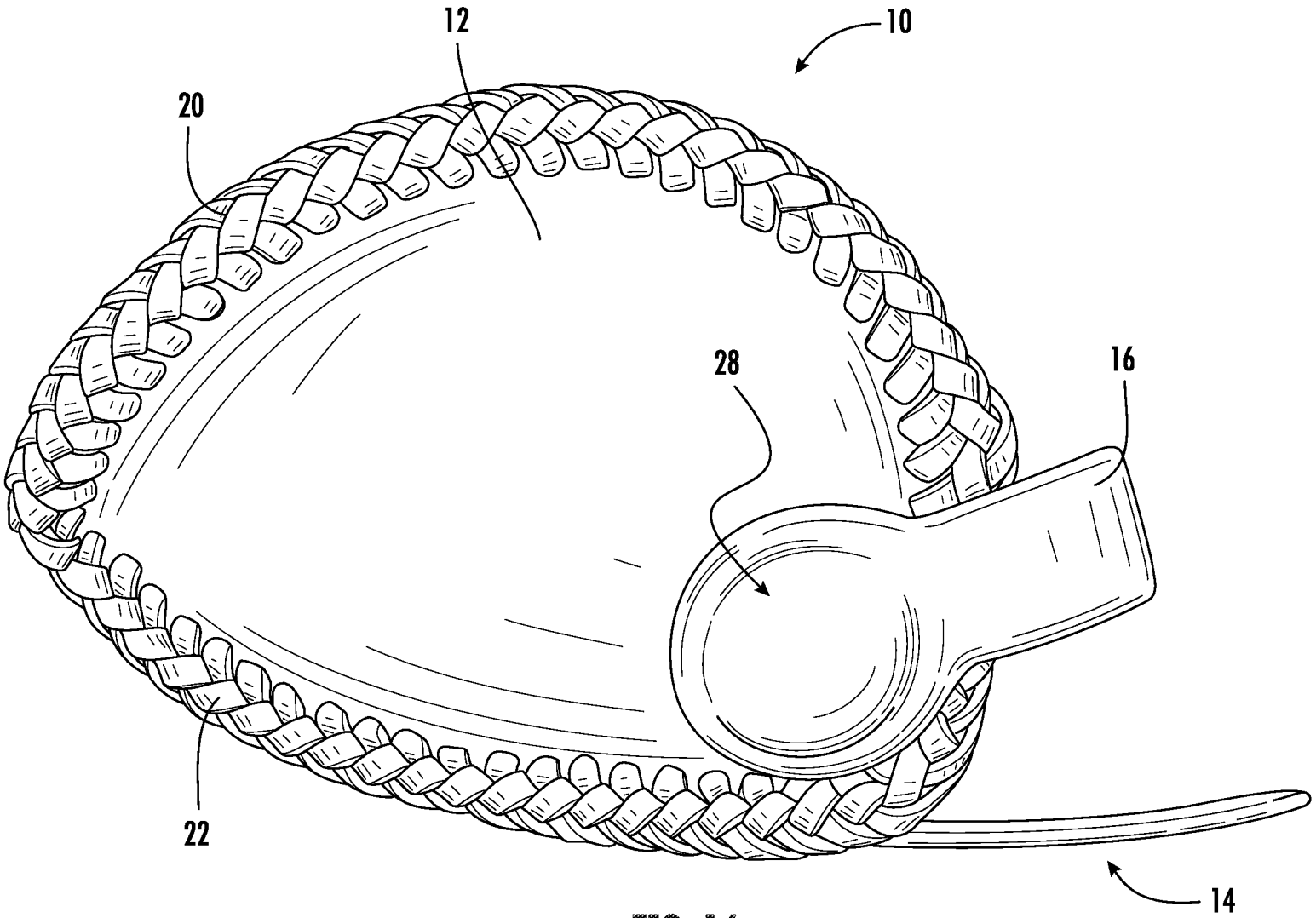
FIG. 16 is a top view of the chin rest, according to one embodiment.
Figure 17:
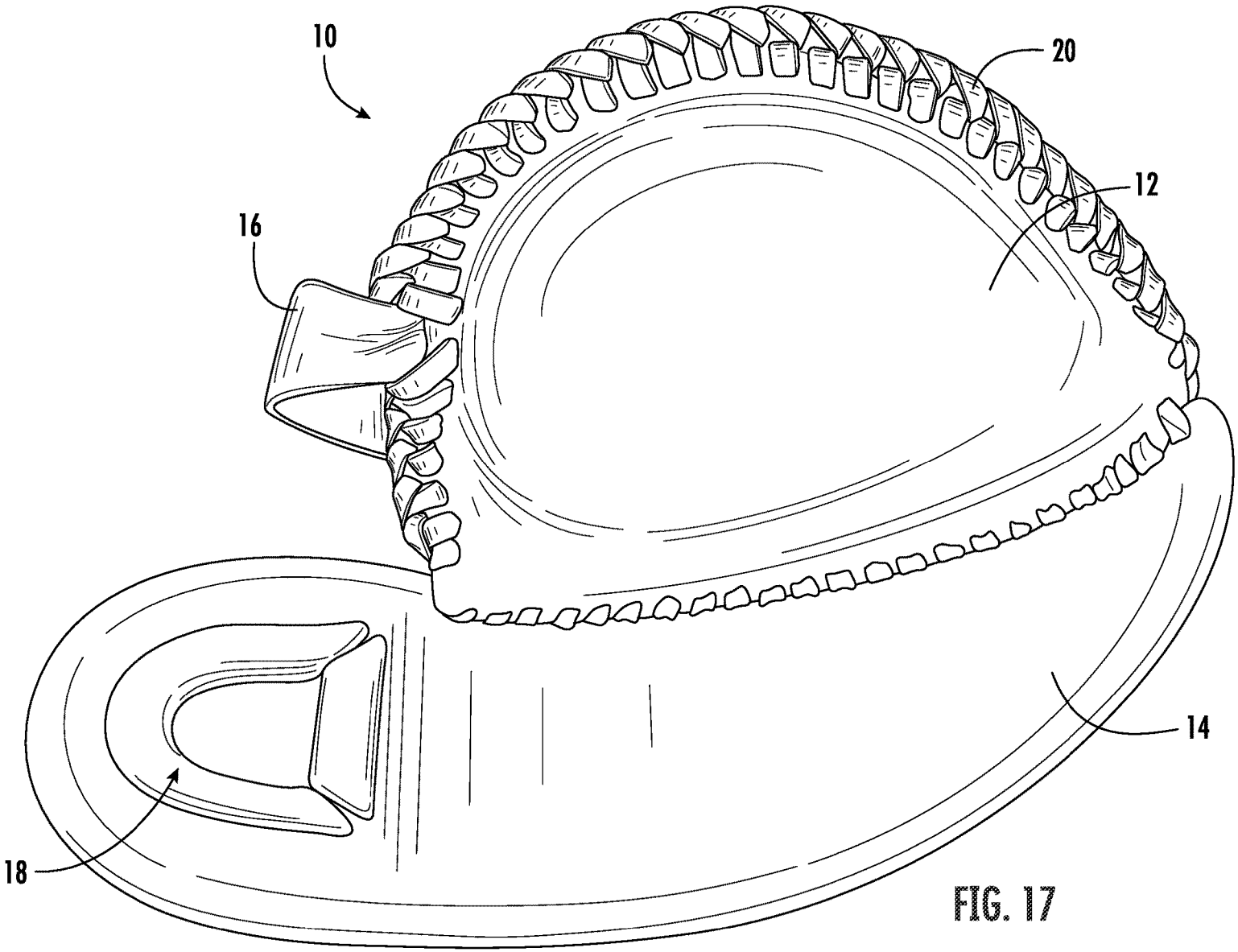
FIG. 17 is a bottom view of the chin rest, according to one embodiment.

According to the embodiment in FIG. 11, the exterior border 20 is located along the edge of the top panel 12, terminating at the connection stitching 22. The exterior border 20 comprises a double cordovan stitch pattern or similar stitching pattern. It will be appreciated that other stitching methods may be used to create the exterior border 20.

In addition to providing a decorative and protective edge along chin rest 10, in one embodiment, the exterior border 20 provides a raised surface along the edges of the top panel 12. This raised surface creates a negative contour to fit a user's chin and jawline and provides a convenient space on which a user may position their chin/jawline when gripping the instrument between the chin/jawline and the shoulder area.

By providing this negative contour on which a user may rest their chin/jawline, pressure on the instrument is displaced outwardly away from the chin/jawline point of contact, thus protecting the body of the instrument.

Similarly, according to one embodiment, the exterior border stitching is present only along the border of the top panel 12, where it may form a negative contour space on the top panel 12 on which a user may rest their chin/jawline, thus displacing pressure outward and reducing isolated pressure points on the body of the instrument. In this embodiment, the edges of the side panel 14 that are not in contact with the top panel 12 may be plain edges or may be hemmed by stitching and/or adhesive.

According to one embodiment, the topmost portion of the side panel 14 (adjacent to the top panel 12) may angle inward towards the interior cavity of the chin rest 10 to reduce movement when the chin rest 10 is being positioned on an instrument. Additionally, the lower edge of the side panel 14 may curve or taper upward as it moves away from the endpin hole 18.

Figure 18:
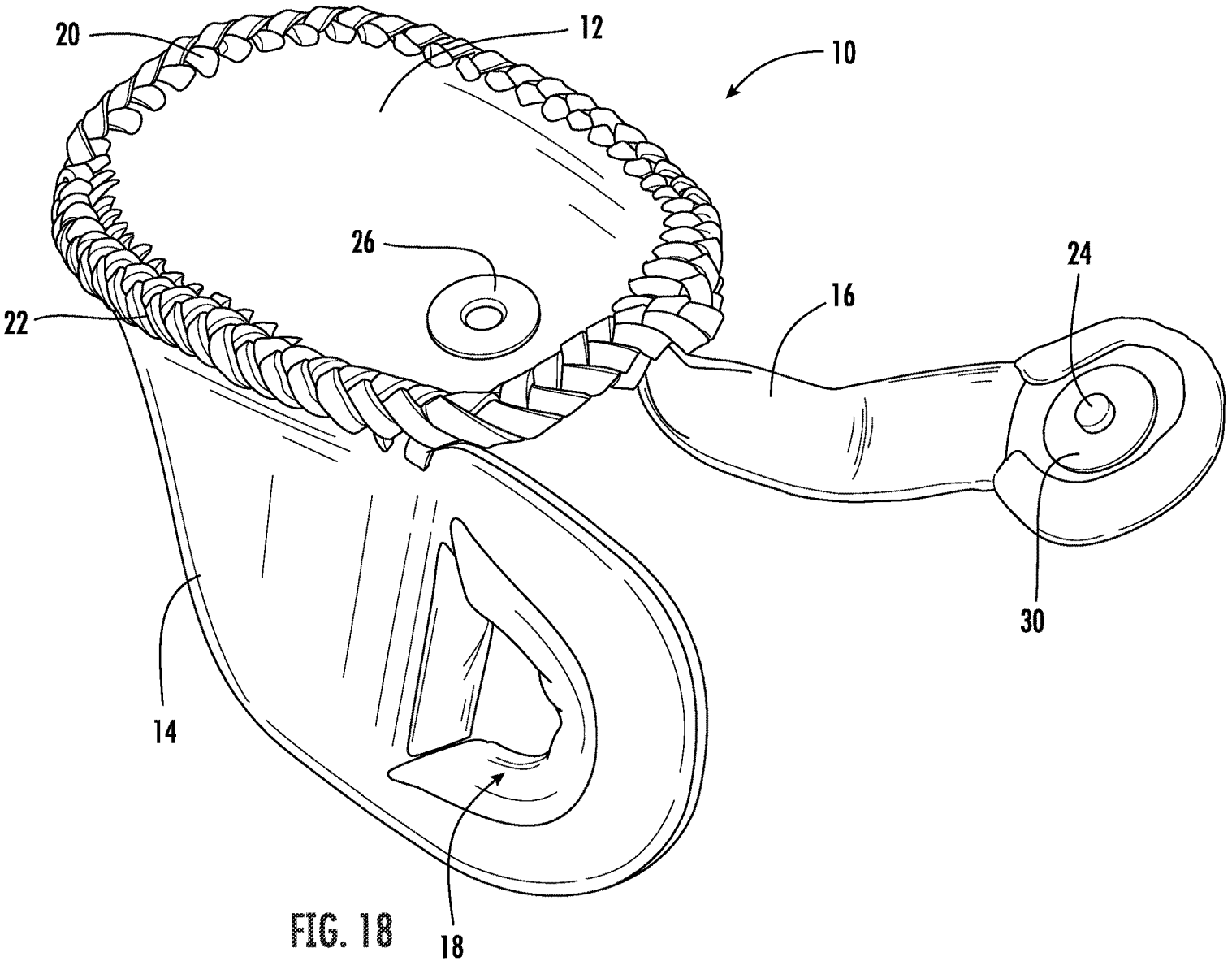
FIG. 18 is a side perspective view of the chin rest, according to one embodiment.

Referring now to FIG. 18, the tailpiece strap 16 can be seen unattached from the top panel 12. In one embodiment shown, the male snap component 24 is embedded in the end of the tailpiece strap 16. The female snap component 26 is embedded in the top panel 12 of the chin rest and may be located adjacent to the attachment point of the tailpiece strap 16. The male snap component 24 of tailpiece strap 16 is designed to pass under and around the tailpiece of a violin, wherein it is secured to the top panel 12 via the female snap component that is embedded in the top panel 12. The snap connection 28 may be a magnetic snap connection, a rivet snap connection, hook-and-loop connection, or similar means of connection.

In one embodiment, the male snap component 24 is surrounded by snap component border 30, which is a raised border surrounding the male snap component 24. The raised nature of the snap component border 30 creates an insulative border around the male snap component 24 and the protruding female snap component 26, to contain and hide the snap connection 28 hardware (male snap component 24 and female snap component 26.)

It will be appreciated by one of ordinary skill in the art that in each of the embodiments disclosed, the components may be composed of sturdy, yet pliable materials such as leather, silicone, rubber, plastic, or other similar materials. Similarly, the interior surface of the, such as suede or soft leather, silicone, rubber, plastic, or other similar, non-abrasive material.

The dimensions and materials specified herein are preferred, but not mandatory, and different dimensions or materials may be used, as desired or necessary for a particular environment or application.

While the present invention has been shown and described in accordance with several preferred and practical embodiments, it is recognized that departures from the instant disclosure are contemplated within the spirit and scope of the present invention.

Thus, a violin chin rest has been described which comprises a top panel connected to a side panel via connection stitching. The side panel includes an endpin hole designed to fit snugly over and around the endpin of an instrument to hold the chin rest to the surface of the violin. A tailpiece strap extends from the top panel to form a loop around the tailpiece of an instrument, securing the chin rest to the instrument. A male snap connector is embedded in the end of the tailpiece strap and a female snap connector is embedded in the top panel, adjacent to the tailpiece strap. Exterior border is located along the exterior edge of the top panel and the side panel.

What is claimed is:

1. A musical instrument chin rest comprising:

a top panel comprising:

a top panel surface;

a receiving component;

a side panel having a side panel surface and a side panel border;

a tailpiece strap comprising:

a connecting component configured to be removably fastened to the receiving component;

an attachment point configured to attach the tailpiece strap to the top panel;

wherein the top panel and the tailpiece strap are comprised of a single piece; and the side panel including an endpin hole.

2. The musical instrument chin rest as recited in claim 1, wherein the receiving component is a female snap fastener component and the connecting component is a male snap fastener component.

3. The musical instrument chin rest as recited in claim 1, wherein the connecting component and the receiving component are configured to be connected via magnetic force.

4. The musical instrument chin rest as recited in claim 1, wherein the connecting component and the receiving component are configured to be connected via hook and loop fastener.

5. The musical instrument chin rest as recited in claim 1, wherein at least a portion of the side panel border is rounded.

6. The musical instrument chin rest as recited in claim 1, wherein the endpin hole is configured to frictionally secure the chin rest to a musical instrument.

7. A musical instrument chin rest comprising:

a top panel comprising:

a top panel surface;

a top panel border;

a receiving component;

wherein the top panel border has a height greater than that of the top panel surface;

a tailpiece strap comprising:

a connecting component configured to be removably fastened to the receiving component;

an attachment point, wherein the attachment point attaches the tailpiece strap to the top panel;

a side panel comprising:

a side panel surface;

a side panel border;

an endpin hole configured to frictionally secure the chin rest to a musical instrument;

wherein the top panel and the tailpiece strap are comprised of a single piece; and wherein the top panel is connected to the side panel at a connection border.

8. The musical instrument chin rest as recited in claim 7, wherein the receiving component is a female snap fastener component and the connecting component is a male snap fastener component.

9. The musical instrument chin rest as recited in claim 7, wherein the connecting component and the receiving component are configured to be connected via magnetic force.

10. The musical instrument chin rest as recited in claim 7, wherein the connecting component and the receiving component are configured to be connected via hook and loop fastener.

11. The musical instrument chin rest as recited in claim 7, wherein at least a portion of the side panel border is rounded.

12. The musical instrument chin rest as recited in claim 7, wherein the attachment point is located opposite the connecting component.

13. A musical instrument chin rest comprising:

a top panel comprising:

a top panel exterior surface;

a top panel interior surface;

a top panel exterior surface border;

a receiving component;

wherein the top panel border has a height greater than that of the top panel surface;

a tailpiece strap comprising:

a connecting component configured to be removably fastened to the receiving component;

an attachment point located opposite the connecting component, wherein the attachment point attaches the tailpiece strap to the top panel exterior surface;

a side panel comprising:

a side panel exterior surface;

a side panel interior surface;

a side panel border;

an endpin hole configured to frictionally secure the chin rest to a musical instrument;

wherein the top panel interior surface and the side panel interior surface form a cavity;

such that the topmost edge of the side panel is angled towards the cavity of the musical instrument chin rest relative to the bottom edge of the side panel;

wherein the top panel is connected to the side panel at a connection border.

14. The musical instrument chin rest as recited in claim 13, wherein the top panel and the tailpiece strap are comprised of a single piece.

15. The musical instrument chin rest as recited in claim 13, wherein the receiving component is a female snap fastener component and the connecting component is a male snap fastener component.

16. The musical instrument chin rest as recited in claim 13, wherein the connecting component and the receiving component are configured to be connected via magnetic force.

17. The musical instrument chin rest as recited in claim 13, wherein the connecting component and the receiving component are configured to be connected via hook and loop fastener.

18. The musical instrument chin rest as recited in claim 13, wherein the top panel interior surface and the side panel interior surface are comprised of a non-abrasive material.

* * * * *